US006030186A

United States Patent [19]

Tang

[11] Patent Number: 6,030,186

[45] Date of Patent: Feb. 29, 2000

[54] METHOD AND APPARATUS FOR MINIMIZING NOISE FROM FAN FILTER UNIT

[75] Inventor: Lee Zong Tang, Singapore, Singapore

[73] Assignee: Kyodo-Allied Industries PTE, Ltd., Singapore

[21] Appl. No.: 09/000,429

[22] PCT Filed: Sep. 3, 1997

[86] PCT No.: PCT/SG97/00040

§ 371 Date: Jan. 30, 1998

§ 102(e) Date: Jan. 30, 1998

[51] Int. Cl.[7] ..... F04B 53/00

[52] U.S. Cl. ..... 417/312; 417/53; 417/313; 417/423.14; 415/119

[58] Field of Search ..... 417/53, 312, 313, 417/423.14; 415/119, 184, 208.2, 208.3, 211.1, 211.2

[56] References Cited

U.S. PATENT DOCUMENTS

| | | | |
|---|---|---|---|
| 1,938,801 | 12/1933 | Bourne et al. | 417/312 |
| 2,330,938 | 10/1943 | Williams | 415/208.3 |
| 3,113,634 | 12/1963 | Watters | 415/119 |
| 4,560,395 | 12/1985 | Davis | 415/119 |
| 4,768,424 | 9/1988 | Frenkler et al. . | |
| 5,346,362 | 9/1994 | Bonner et al. | 415/119 |
| 5,462,482 | 10/1995 | Grimes . | |
| 5,470,363 | 11/1995 | Leader et al. | 55/276 |
| 5,601,400 | 2/1997 | Kondo et al. . | |

FOREIGN PATENT DOCUMENTS

| | | |
|---|---|---|
| 43 20 162 | 12/1994 | Germany . |
| 44 12 583 | 9/1995 | Germany . |
| WO93/01454 | 11/1993 | WIPO . |

*Primary Examiner*—Charles G. Freay
*Assistant Examiner*—Cheryl J. Tyler
*Attorney, Agent, or Firm*—Quarles & Brady

[57] ABSTRACT

A system of geometric guides and baffles is used for directing and diffusing external air drawn from a fan blower before distributing the flow evenly to the outlet of a fan filter unit. This arrangement not only reduces the turbulence within a fan filter unit but also maintains the particle count of air drawn through the same system. Furthermore, the present invention is implemented in dimensions substantially similar to that of the fan blower. As such, the present invention minimizes noise of a fan filter unit even in confined clean room facility.

12 Claims, 5 Drawing Sheets

METHOD AND APPARATUS FOR MINIMIZING NOISE FROM FAN FILTER UNIT

FIELD OF THE INVENTION

The present invention relates to a method and apparatus for minimising noise from air moving devices. In particular, the present invention pertains to a system for reducing noise from a fan filter unit in a clean room facility.

BACKGROUND OF THE INVENTION

It is common for a modern production and testing facility to control the particles in the air that circulates within a clean room facility in order to ensure the quality of its output. Whether be it wafer dies, compact discs or memory disk drives, effective fan filter units are needed to not only keep the particle contents within the clean room at acceptable levels but also to circulate the air which the workers breathe.

Such powerful fan filter units create excessive noise however. It is known that the insulation material are lined along the conduit or within the fan filter units to reduce the noise generate by the fan blowers. Over time, however, the particles or fiber from the insulation material are dislodged from the surface and contaminate the clean room facility.

The problem associated with the particle contents in clean room facility is exacerbated in confined space or enclosures such as a multi-story wafer fabrication plant. By confined space, the present invention envisages the height of the ceiling to be less than three meters. Because of the low height clearance, the noise from fan filter units is particularly pronounced.

OBJECT OF THE INVENTION

It is an object of the present invention to minimise the noise generated by fan filter units without increasing the particle counts of a clean room facility connected to such units.

It is another object of the present invention to minimise the noise generated by fan filter units without doing away with existing fan blower in a confined clean room facility.

SUMMARY OF THE INVENTION

The present invention is a system of geometric guides and baffles for directing and diffusing the external air drawn from a fan blower before distributing the flow evenly to the outlet a fan filter unit. This arrangement not only reduces the turbulence within a fan filter unit but also maintains the particle count of air drawn through the same system. Furthermore, the present invention is implemented in dimensions substantially similar to that of the fan blower. As such, the present invention minimises noise of a fan filter unit even in confined clean room facility.

DESCRIPTION OF THE EMBODIMENT OF THE INVENTION

A method and apparatus for minimising noise from a fan filter unit is described. In the following description, numerous specific details are set forth such as guides and baffles, etc. in order to provide a thorough understanding of the present invention. In other instances, well-known parts such as the motors for the fan blower and ducts connected to the fan filter units are not shown in order not to obscure the present invention.

Figure 1:
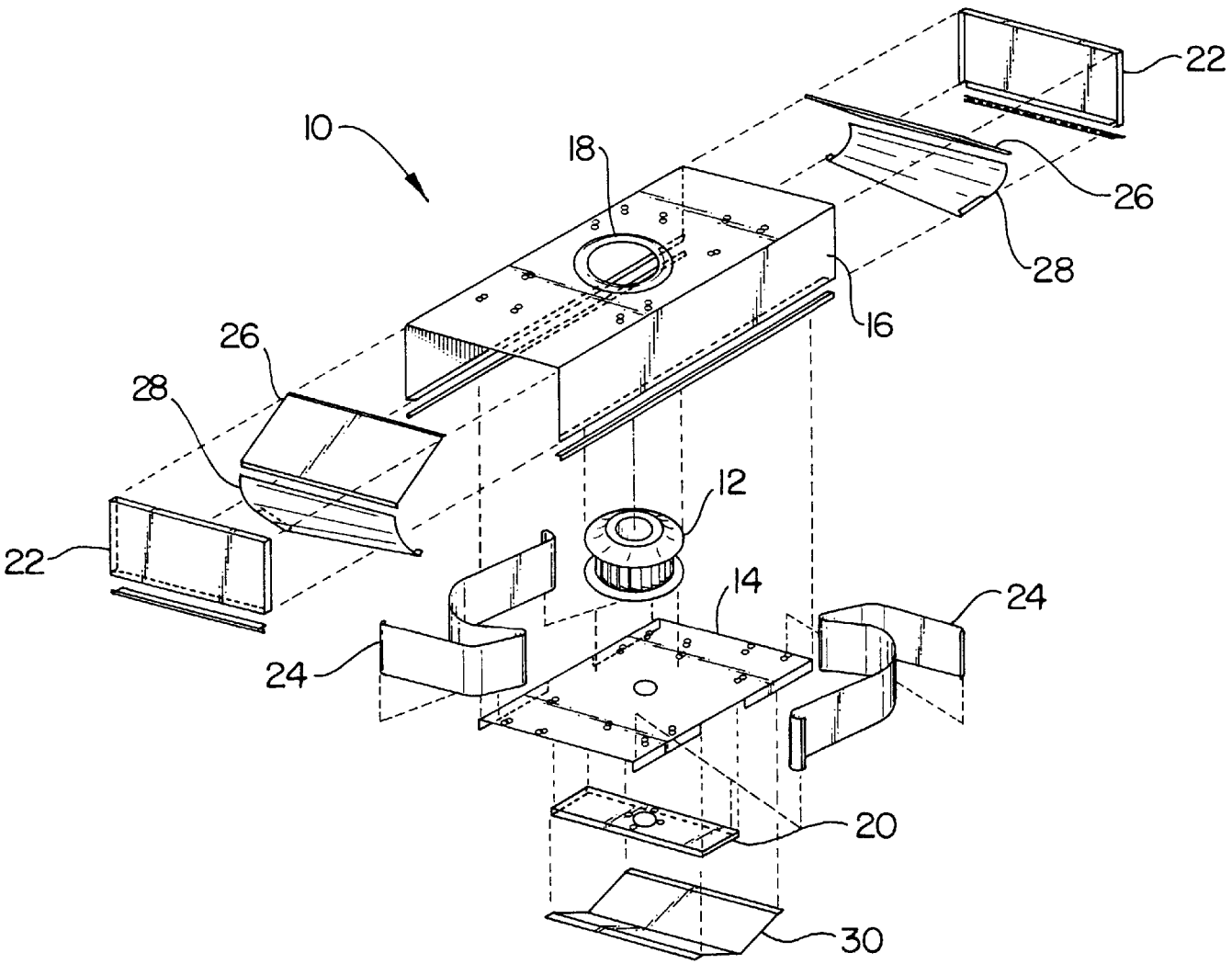
FIG. 1 is a exploded, right side, perspective elevational view of the present invention being integrated as part of a fan filter unit (filter not shown).

FIG. 1 is a exploded, right side, perspective elevational view of the present invention being integrated as part of a fan filter unit 10 (filter not shown). The fan filter unit comprises a fan blower 12 disposed within a base plate 14, a top housing 16 and side housings 22 respectively. The fan blower is supported in the base plate by a mounting 20 on the underside of the base plate. Not shown but crucial to the fan filter unit 10 is a motor disposed underneath the fan blower 12 for providing rotational movement for the fan blower.

Figure 2:
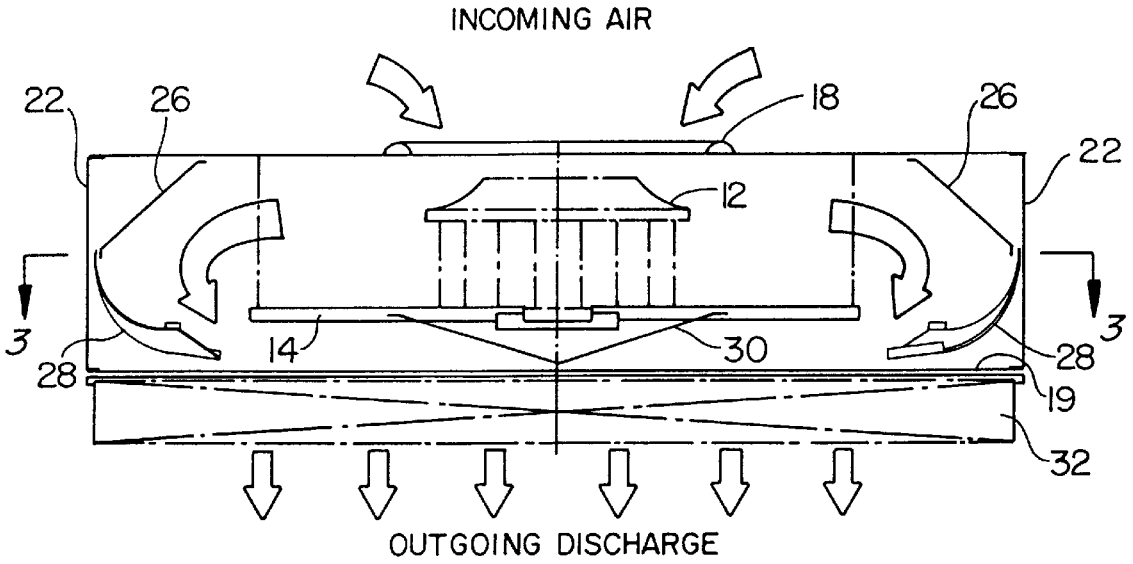
FIG. 2 is a front, cross sectional elevational view of the system of geometric guides and baffles of the present invention together with filter of a fan filter unit.

By itself, the fan filter unit draws air externally from an air inlet 18 and discharges it via outlet opening 19 as shown in FIG. 2. At the outlet opening is disposed a filter 32 for removing large particles or contaminants. While the fan filter unit is effectively circulating or ventilating air in clean room facility, the noise generated by such unit is annoying. It is a practice in the industry to insulate the fan filter unit by lining the interior of the fan filter with insulating materials such as sponge, PVC foam, or fiber glass. Unfortunately, over time such insulating material tend to contaminate clean room facility as particles from the surface is dislodged and introduced into the air flow through the fan filter unit. Without the knowledge of the clean room operator, the fan filter unit becomes a source of contaminant. In the process, the output from clean room facility such as wafer die, compact discs or disk drives is contaminated.

Referring again to FIG. 1, the present invention is a method and apparatus for placing geometric guides and baffles in strategic locations along the path of airflow within the fan filter unit to minimise noise from it without contaminating the air flowing through it. The present invention comprises at least a set of S shaped guides 24 disposed circumferentially the fan blower, another set of porous baffles 26 and curved baffles 28 for diffusing and directing air from the S shaped guides 24 and finally a V shaped baffle 30 below the fan blower for distributing air evenly to the filter 30.

Figure 3:
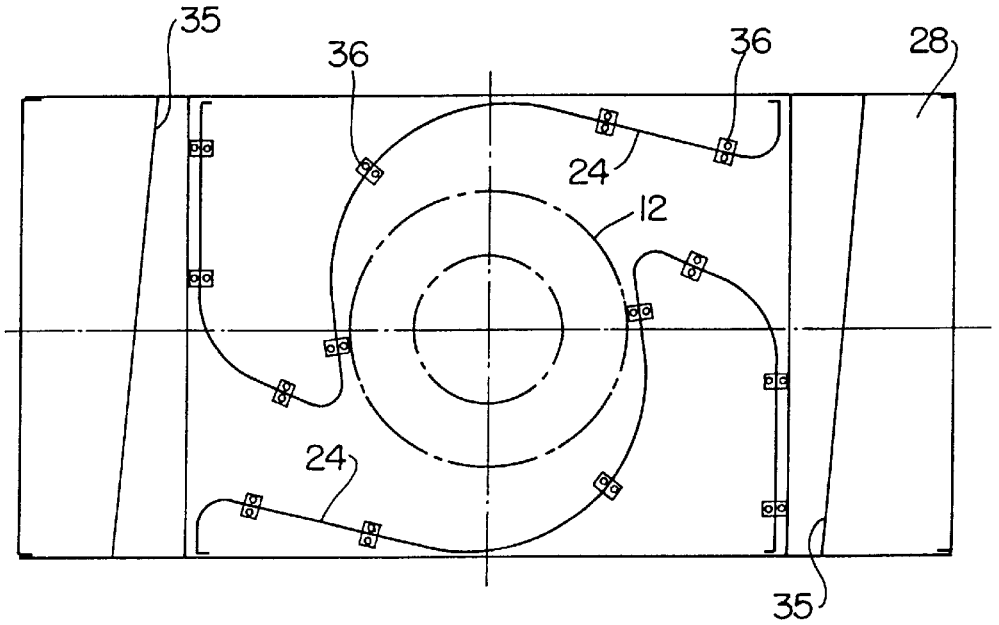
FIG. 3 is a top, plan elevational view of section A—A in FIG. 2 highlighting the S shaped guide and curved baffle of the present invention.

FIG. 3 is a top, plan elevational view of section A—A in FIG. 2 highlighting the S shaped guide and curved baffle of the present invention. The S shaped guides 24 are contoured to receive the discharged air from the fan blower 12 (shown in dotted circle) and guide the flow of air with minimum amount of turbulence towards a set of perforated baffles 26. Preferably the S shaped guides are made of metallic material whose spring back effect enable the installer to install it easily by inserting it between a plurality of clips disposed on the base plate 14. The perforated baffles 26 can be a sheet of metal with a matrix of holes. In the preferred embodiment of the present invention, the holes are 3.3 mm in diameter with about 50% spacing. The perforated baffles disposed at angles of about 45 degree to diffused the air from the S shaped guides 24. Adjacent and below the lower edge of the perforated baffles 26 are disposed the curved baffles 28 for redirecting the flow of air below the base plate. Although the curved baffles 28 can take on a straight leading edge, the present invention recommends straight but sloping leading edges 35 as illustrated in FIGS. 2 and 3. Note also in FIG. 3 that the placement of S shaped guides 24, the perforated baffles 26, and the curved baffles 28 are symmetrical to each other with reference to a rotational axis of 180 degrees centered at the fan blower. Last but not the least is the V shaped baffle 30 disposed below the fan blower mounting for distributing the air flow evenly before discharging it through the outlet opening 19 of the fan filter unit 10.

Figure 4:
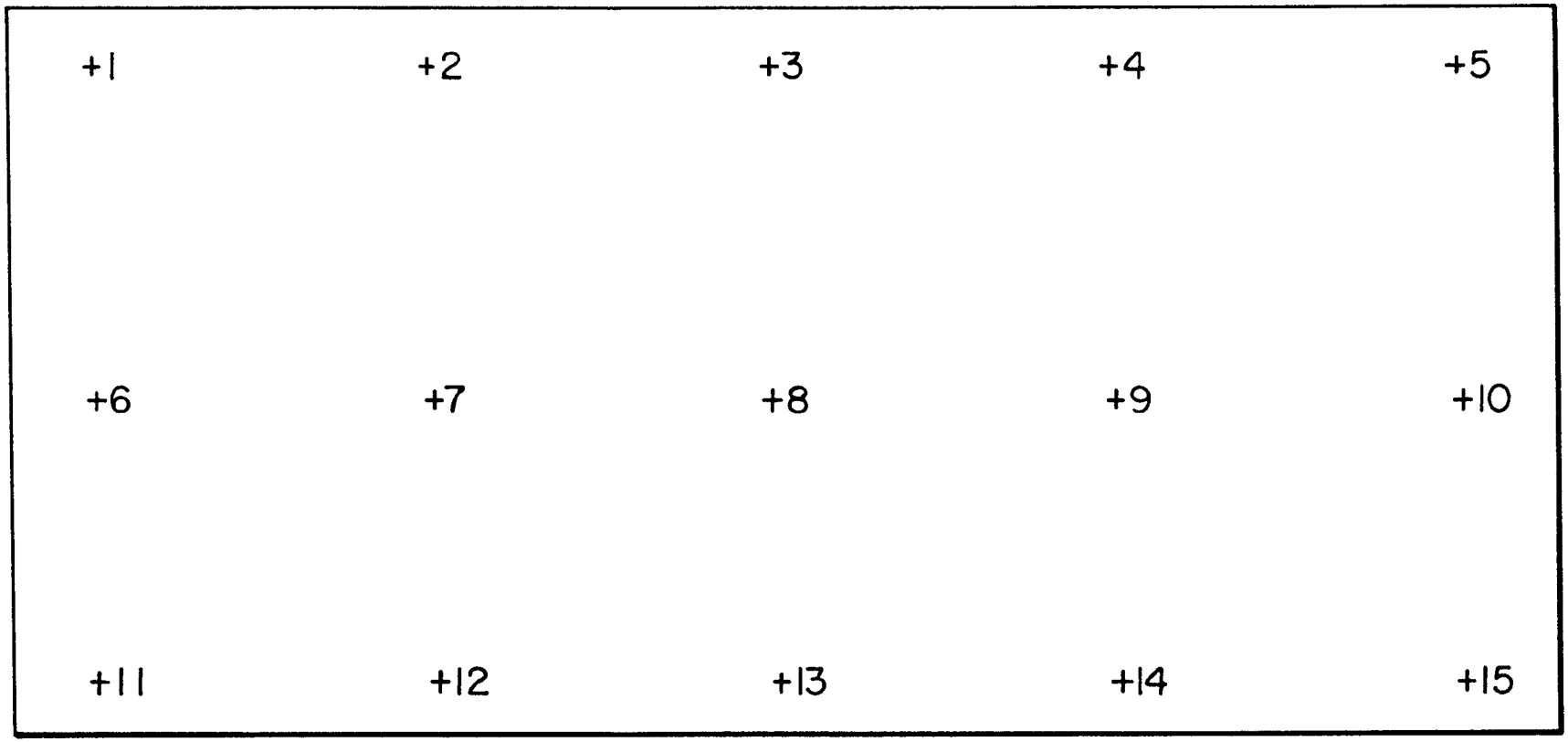
FIG. 4 shows the locations in the fan filter units where the velocity of airflow were measured.
Figure 5:
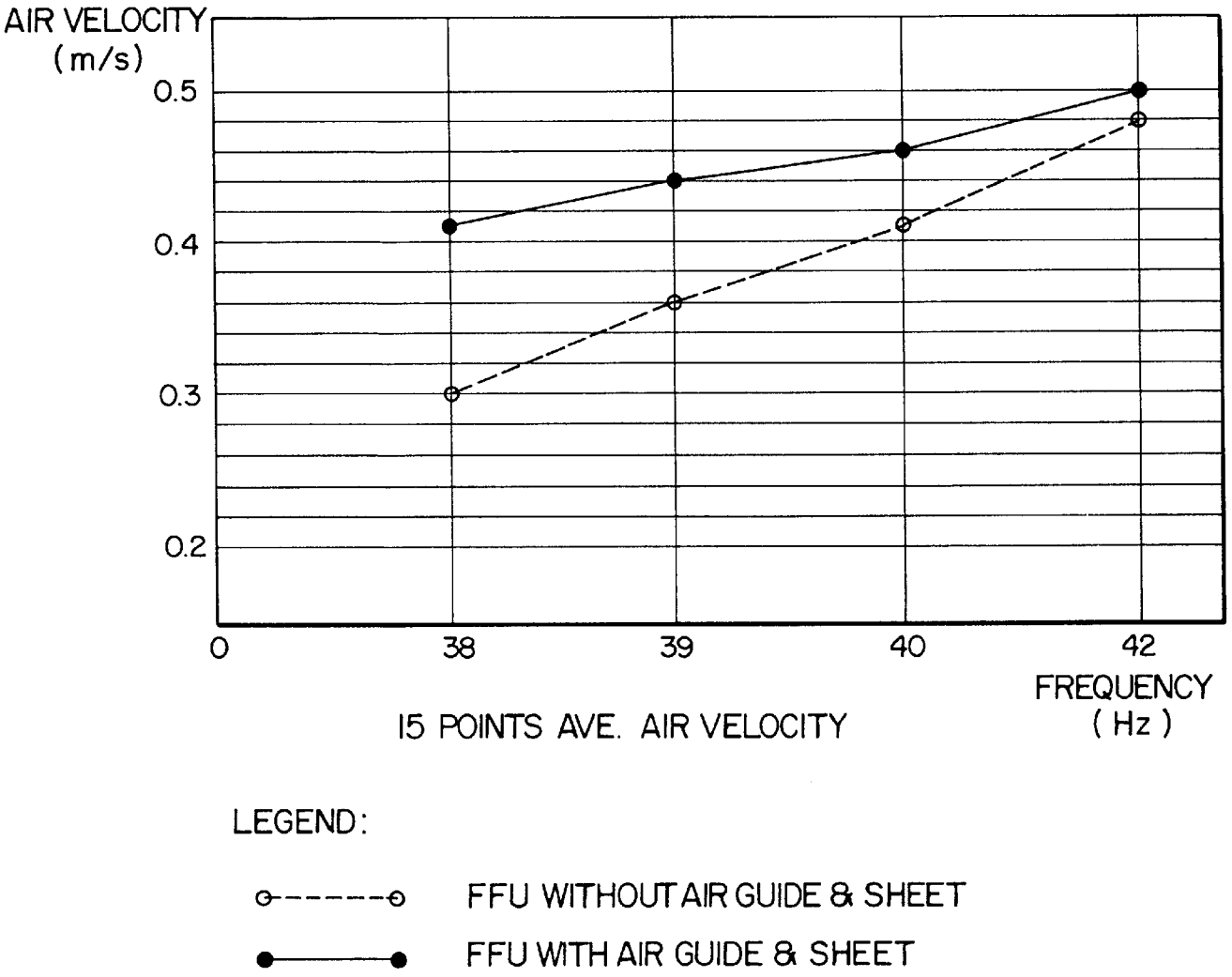
FIG. 5 is a chart comparing the average velocity of airflow of a fan filter unit with and without the present invention over a range of fan blower power supply (measured in Hz).

FIG. 5 is a chart comparing the average velocity of airflow of a fan filter unit with and without the present invention over a range of fan blower settings (measured in Hz). The average velocity of airflow is measured at fifteen different points in the fan filter unit and illustrated in FIG. 4 respectively. Referring to FIG. 5, one can appreciate that the average velocity of a fan filter unit with the present invention is higher and more even than that without the present invention. It is evident that pressure loss of a fan filter unit having the present invention is less than that without the present invention. As such, considerable energy saving over time can be achieved.

Figure 6:
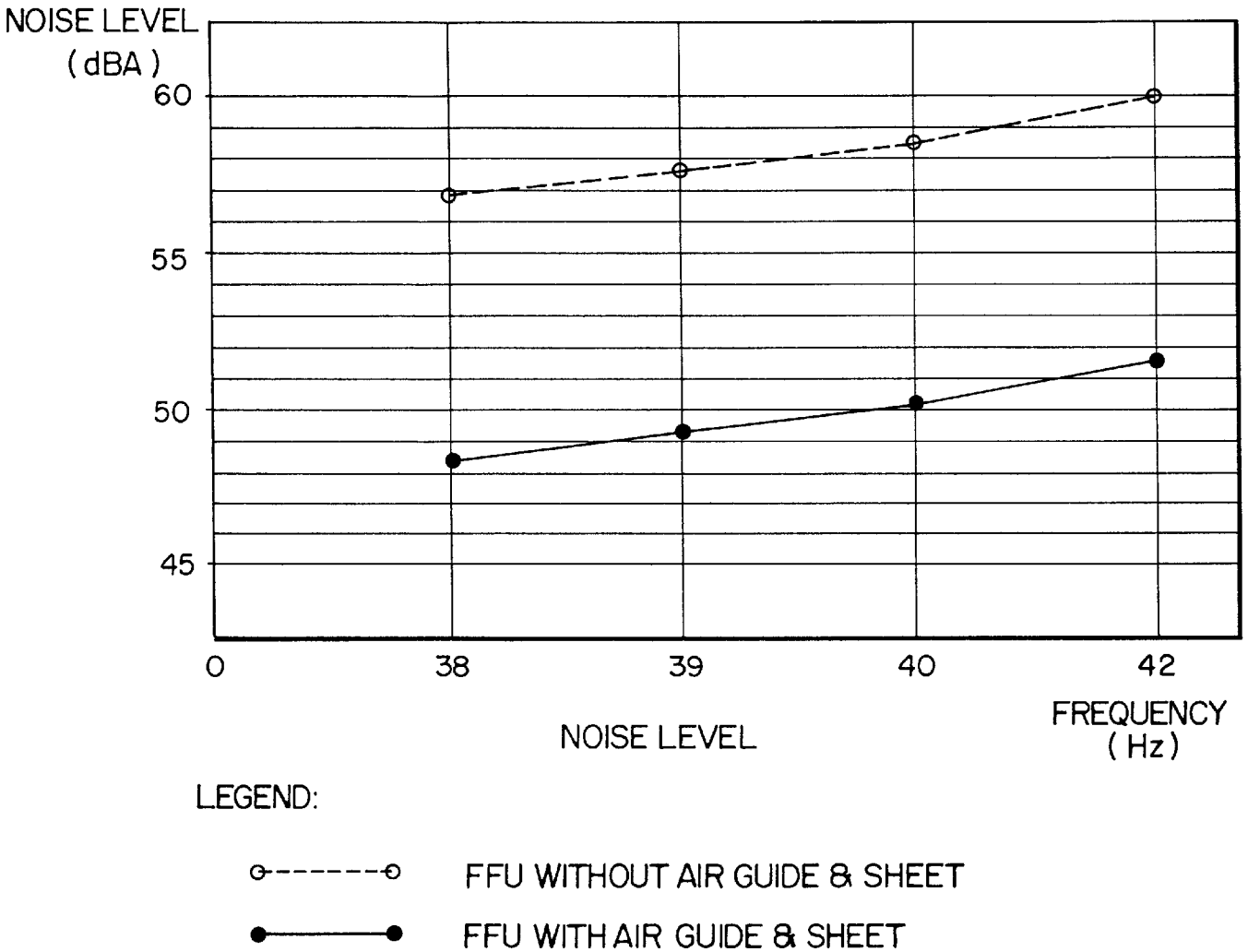
FIG. 6 is a chart comparing the noise level from a fan filter unit with and without the present invention and is measured at a location one meter directly below the outlet of the unit.

Finally and most importantly, FIG. 6 is a chart comparing the noise level from a fan filter unit with and without the present invention and is measured at a location one meter directly below the outlet of the unit. Measured one meter below a fan filter unit, the present invention allows the fan filter unit to operate with far less noise than one without the present invention.

While the present invention has been described particularly with reference to FIGS. 1 to 6 with emphasis on a method and apparatus for minimising noise from a fan filter unit, it should be understood that the figures are for illustration only and should not be taken a limitation on the invention. In addition, it is clear that the method and apparatus of the present invention have utility in many applications where noise reduction is required. It is contemplated that many changes and modifications may be made by one of ordinary skill in the art without departing from the spirit and the scope of the invention as described.

I claim:

1. An apparatus for minimizing noise from a fan filter unit, said fan filter unit comprising at least a fan blower disposed on a base plate, a top housing coupled to said base plate with an inlet opening for drawing air therethrough, and side housing coupled to said top housing for enclosing the fan filter unit, said side housing further having an outlet opening through which air is discharged, said apparatus comprising:

at least a pair of S shaped guides disposed on said base plate within said fan filter unit and circumferentially of said fan blower for receiving air discharged therefrom;

at least a pair of perforated baffles disposed within the fan filter unit and at output of said S shaped guides for diffusing the airflow therefrom;

at least a pair of curved baffles disposed within said fan filter unit and adjacent to said perforated baffles for directing airflow blow said base plate; and at least one V shaped baffle disposed on the underside of said base plate for distributing evenly the airflow, whereby the noise from said fan filter unit is minimised without introducing contaminants in the airflow flowing therethrough.

2. An apparatus for minimizing noise from a fan filter unit as in claim 1 wherein said S shaped guides are made of metal.

3. An apparatus for minimizing noise from a fan filter unit as in claim 1 wherein said perforated baffles are made of metal.

4. An apparatus for minimizing noise from a fan filter unit as in claim 1 wherein said curved baffles are made of metal.

5. An apparatus for minimizing noise from a fan filter unit as in claim 1 wherein said V shaped baffle is made of metal.

6. An apparatus for minimizing noise from a fan filter unit as in claim 1 wherein said S shaped guides are coupled to said base plate with a plurality of clips.

7. An apparatus for minimizing noise from a fan filter unit as in claim 1 wherein said perforated baffles are disposed at an angle of 45 degrees with the surface of said side housings.

8. An apparatus for minimizing noise from a fan filter unit as in claim 1 wherein:

said curved baffles have edges; and, said edges are substantially curved.

9. An apparatus for minimizing noise from a fan filter unit as in claim 1 wherein:

said curved baffles have edges and corners; and, said edges are substantially straight between said corners.

10. An apparatus for minimizing noise from a fan filter unit as in claim 1 wherein said curved baffles have sloping leading edges.

11. An apparatus for minimizing noise from a fan filter unit as in claim 1 wherein said V shaped baffle traverses the height of airflow path below said base plate.

12. A method for minimizing noise from a fan filter unit, said fan filter unit comprising at least a fan blower disposed on a base plate, a top housing coupled to said based plate with an inlet opening for drawing air therethrough, and side housing coupled to said top housing for enclosing the fan filter unit, said side housing further having an outlet opening through which air is discharged, said method comprising the steps of:

for receiving air discharged from at least a pair of S shaped guides disposed on said base plate within said fan filter unit and circumferentially of said fan blower;

diffusing the airflow with at least a pair of perforated baffles disposed within the fan filter unit and at output of said S shaped guides;

directing airflow blow said base plate with at least a pair of curved baffles disposed within said fan filter unit and adjacent to said perforated baffles; and distributing evenly the airflow with at least one V shaped baffle disposed on the underside of said base plate, whereby the noise from said fan filter unit is minimised without introducing contaminants in the airflow flowing therethrough.

* * * * *

UNITED STATES PATENT AND TRADEMARK OFFICE

CERTIFICATE OF CORRECTION

PATENT NO : 6,030,186
DATED : Feb. 29, 2000
INVENTOR(S) : LEE, Zong Tang

It is certified that error appears in the above-identified patent and that said Letters Patent are hereby corrected as shown below:

In the Inventors Name, replace "Lee Zong Tang" with --Zong Tang Lee--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,030,186
APPLICATION NO. : 09/000429
DATED : February 29, 2000
INVENTOR(S) : Zong Tang Lee It is certified that error appears in the above-identified patent and that said Letters Patent is hereby corrected as shown below:

Title Page, item (75); INVENTOR, replace "Lee Zong Tang" with --Zong Tang Lee--

Signed and Sealed this

Twenty-second Day of May, 2007

JON W. DUDAS
*Director of the United States Patent and Trademark Office*